US010024232B2

(12) United States Patent
Choi et al.

(10) Patent No.: US 10,024,232 B2
(45) Date of Patent: Jul. 17, 2018

(54) VARIABLE COMPRESSION RATIO APPARATUS

(71) Applicant: Hyundai Motor Company, Seoul (KR)

(72) Inventors: Myungsik Choi, Seoul (KR); Dae Sung Kim, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 15/248,308

(22) Filed: Aug. 26, 2016

(65) Prior Publication Data

US 2017/0167370 A1 Jun. 15, 2017

(30) Foreign Application Priority Data

Dec. 15, 2015 (KR) ..... 10-2015-0179512

(51) Int. Cl.
*F02B 75/32* (2006.01)
*F02B 75/04* (2006.01)

(52) U.S. Cl.
CPC ..... *F02B 75/048* (2013.01); *F02B 75/045* (2013.01)

(58) Field of Classification Search
CPC ..... F02B 75/048; F02B 75/047; F02B 75/32; F02D 15/02
USPC ..... 123/197.3
See application file for complete search history.

(56) References Cited

U.S. PATENT DOCUMENTS 5,451,177 A * 9/1995 Gilman ..... A63F 7/3622 403/338
6,113,005 A * 9/2000 Chih ..... B08B 9/0433 134/167 C
6,155,862 A * 12/2000 Chiu ..... H01R 13/6278 439/347
6,701,885 B2 * 3/2004 Klomp ..... F02B 75/045 123/197.4
7,669,559 B2 * 3/2010 Aoyama ..... F02D 13/023 123/48 B
7,802,544 B2 * 9/2010 Kamada ..... F02B 75/048 123/197.4

(Continued)

FOREIGN PATENT DOCUMENTS

JP 64-021233 U 2/1989
JP 2007-009834 A 1/2007

(Continued)

*Primary Examiner* — Marguerite McMahon
*Assistant Examiner* — James Kim
(74) *Attorney, Agent, or Firm* — Morgan, Lewis & Bockius LLP

(57) ABSTRACT

A variable compression ratio apparatus, which is provided to an engine rotating a crank shaft upon receiving combustion power of a mixture from a piston for changing a compression ratio of the mixture, may include a connecting rod transferring combustion power of the mixture received from the piston to the crankshaft, and including a small end rotatably connected with the piston and a large end forming a circular hole, a crank pin, an eccentric cam disposed to be concentrically rotatable in the hole of the large end, an eccentric link at which the eccentric cam is disposed at a first end, a variable link having a first end rotatably connected with a second end of the eccentric link, a control link having a first end rotatably connected with a second end of the variable link, and a control shaft controlled by a controller and rotated together with the control link.

5 Claims, 5 Drawing Sheets

(56) References Cited

U.S. PATENT DOCUMENTS

| | | | | |
|---|---|---|---|---|
| 8,267,055 | B2 * | 9/2012 | Pattakos | F02B 75/047 123/48 B |
| 8,776,736 | B2 * | 7/2014 | Woo | F02B 75/045 123/48 A |
| 2006/0156671 | A1 * | 7/2006 | Montague | E04B 1/6183 52/586.2 |
| 2008/0098990 | A1 * | 5/2008 | Hiyoshi | F02D 13/023 123/48 B |
| 2011/0192371 | A1 * | 8/2011 | Satou | F02B 75/048 123/197.4 |

FOREIGN PATENT DOCUMENTS

| | | | |
|---|---|---|---|
| JP | 2009-036128 | A | 2/2009 |
| KR | 10-2012-0002343 | A | 1/2012 |
| KR | 10-1338461 | B1 | 12/2013 |
| KR | 10-1354163 | B1 | 1/2014 |

* cited by examiner

VARIABLE COMPRESSION RATIO APPARATUS

CROSS-REFERENCE TO RELATED APPLICATION

The present application claims priority to Korean Patent Application No. 10-2015-0179512, filed Dec. 15, 2015, the entire contents of which is incorporated herein for all purposes by this reference.

BACKGROUND OF THE INVENTION

Field of the Invention

The present invention relates to a variable compression ratio apparatus and, more particularly, to a variable compression ratio apparatus in which a compression ratio of a mixture in a combustion chamber is varied according to an operational state of an engine.

Description of Related Art

Generally, heat efficiency of a heat engine is increased when a compression ratio is high, and in case of a spark ignition engine, when an ignition time is advanced to a certain level, heat efficiency is increased. But, when an ignition time of a spark ignition engine is advanced at a high compression ratio, abnormal combustion occurs to damage the engine, so there is a limitation in advancing an ignition time and a corresponding degradation of an output should be tolerated.

A variable compression ratio (VCR) apparatus is an apparatus for changing a compression ratio of a mixture according to an operational state of an engine. According to the VCR apparatus, a compression ratio of a mixture is increased in a low load condition to enhance mileage (or fuel efficiency), and the compression ratio of the mixture is lowered in a high load condition to prevent a generation of knocking and enhance an engine output.

The related art VCR apparatus implements a change in a compression ratio by changing a length of a connecting rod connecting a piston and a crank shaft. In the VCR apparatus, the part connecting the piston and the crack shaft includes several links, directly transmitting combustion pressure to the links. Thus, durability of the links weakens.

Various experimentation results with respect to the related art VCR apparatus revealed that operation reliability is high when a distance between the rank pin and the piston pin is changed by using an eccentric bearing. Meanwhile, when hydraulic pressure is used to rotate an eccentric cam, an amount of rotation and an amount of hydraulic outflow of the eccentric cam of each cylinder are different, result in problems in that a compression ratio of each cylinder is not uniform and a time during which a compression ratio is changed varies according to engine operational conditions.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a variable compression ratio (VCR) apparatus having advantages of changing a compression ratio of a mixture by installing an eccentric cam in a large end portion of a connecting rod and rotating the eccentric cam by using link members.

According to various aspects of the present invention, a variable compression ratio apparatus which is provided to an engine rotating a crank shaft upon receiving combustion power of a mixture from a piston for changing a compression ratio of the mixture may include a connecting rod transferring combustion power of the mixture received from the piston to the crankshaft, and including a small end rotatably connected with the piston and a large end forming a circular hole for rotatable and eccentric connection with the crankshaft, a crank pin disposed at the crankshaft, an eccentric cam disposed to be concentrically rotatable in the hole of the large end for eccentric insertion and rotatable connection of the crank pin, an eccentric link at which the eccentric cam is disposed at a first end to rotate together with the eccentric cam, a variable link having a first end rotatably connected with a second end of the eccentric link, a control link having a first end rotatably connected with a second end of the variable link, and a control shaft controlled by a controller to be disposed at a second end of the control link and rotated together with the control link.

The rotation of the control link rotating together with the control shaft may rotate the eccentric link through the variable link.

The control shaft may be controlled by the controller to rotate according to driving conditions of the engine.

The eccentric cam may include a main body at which the eccentric link is formed or disposed, and at which a first part of the hole into which the crank pin is inserted is formed, and a sub body at which a second part of the hole into which the crank pin is inserted is formed, and a sub body insertion space is formed at the main body and the sub body is disposed in the sub body insertion space.

The sub body insertion space may be formed in a shape depressed along a radial direction from an external circumference of the eccentric cam.

The sub body may be formed in a semicircle shape and the sub body insertion space may be formed in a shape corresponding to the sub body.

The hole into which the crank pin is inserted is formed by insertion of the sub body of the eccentric cam into the sub body insertion space of the main body.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
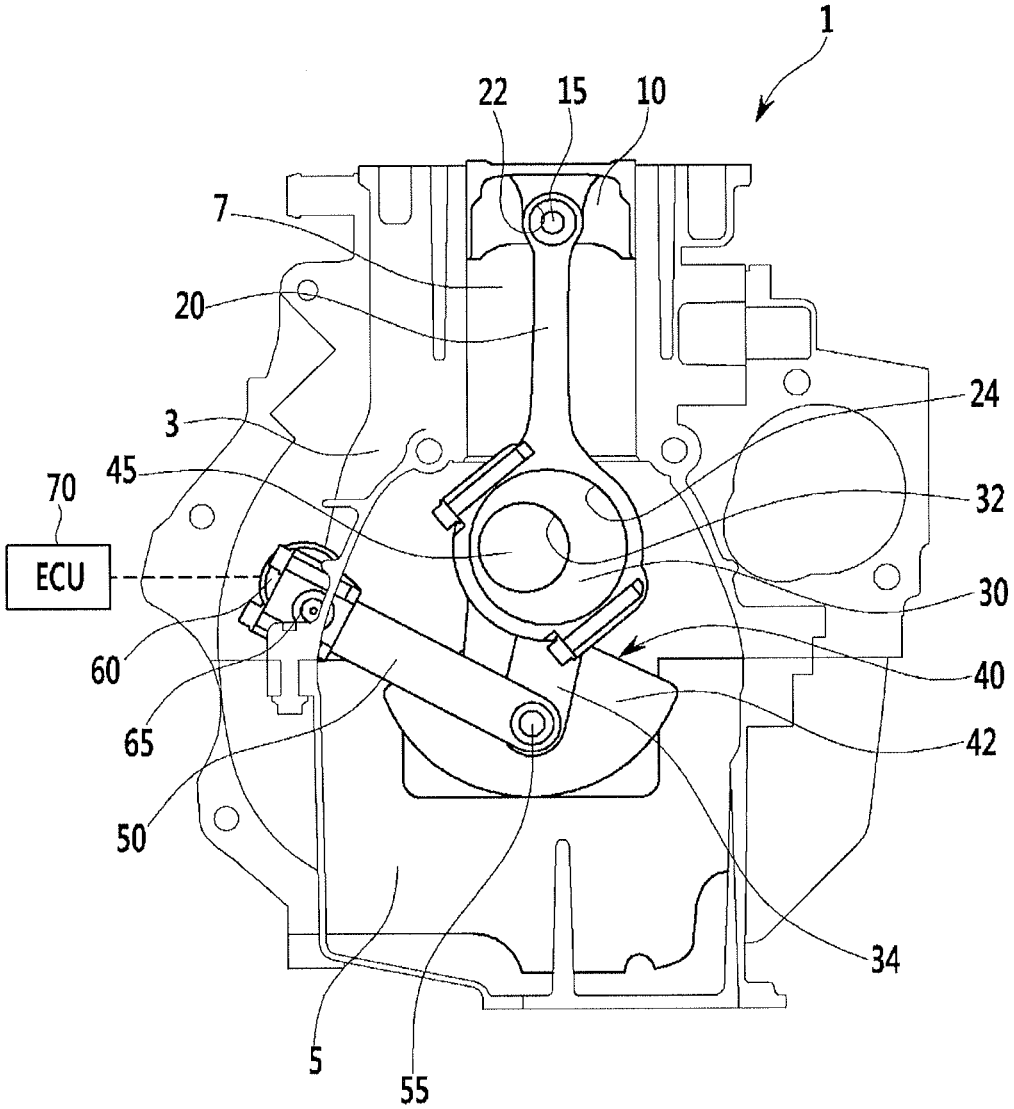
FIG. 1 is a schematic diagram of a variable compression ratio apparatus according to various embodiments of the present invention.

FIG. 1 is a schematic diagram of a variable compression ratio apparatus according to various embodiments of the present invention.

FIG. 1 shows a section of an engine for representing a configuration of a variable compression ratio apparatus 1. That is, illustrating a cylinder block 3 and an oil pan 5 by sections is for easily showing the configuration in which members of the variable compression ratio apparatus 1 are connected with each other in the engine.

As shown in FIG. 1, a variable compression ratio apparatus 1 according to various embodiments of the present invention is mounted to an engine rotating a crankshaft 40 upon receiving combustion power of a mixture from a piston 10 so as to change a compression ratio of the mixture according to driving conditions of the engine.

The piston 10 makes a vertical movement within a cylinder 7, and a combustion chamber is formed between the piston 10 and the cylinder 7.

The crankshaft 40 receives combustion power from the piston 10 and transforms this combustion power to torque so as to transfer to a transmission. The crankshaft 40 in the cylinder 7 is mounted in a crank case which is formed at a lower end of the cylinder 7. In addition, a plurality of balance weights 42 is mounted at the crankshaft 40. The balance weights 42 reduce vibration being generated by rotation of the crankshaft 40.

Herein, the combustion chamber which is formed as a cylinder head is coupled with the cylinder block 3 and the crank case which is configured by coupling an upper crank case formed at the cylinder block 3 and a lower crank case formed at the oil pan 5 are well known to a person of an ordinary skill in the art, so detailed description thereof will be omitted.

The variable compression ratio apparatus 1 according to various embodiments of the present invention includes a connecting rod 20, an eccentric link 34, an eccentric cam 30, a variable link 50, a control link 65, and a control shaft 60.

The connecting rod 20 receives combustion power from a piston 10 and transfers combustion power to a crankshaft 40. In order to transfer the combustion power, one end of the connecting rod 20 is rotatably connected to the piston 10 by a piston pin 15, and the other end of the connecting rod 20 is eccentrically and rotatably connected to the crank shaft 30. In general, one end portion of the connecting rod 20 connected to the piston 10 is called a small end portion, and the other end portion of the connecting rod 20 connected to the crank shaft 30 is called a large end portion.

The connecting rod 20 includes a piston pin installation hole 22 and an eccentric cam installation hole 24.

The piston pin installation hole 22 is formed in the small end portion of the connecting rod 20. In addition, the piston pin installation hole 22 has a circular shape to allow the small end portion of the connecting rod 20 to be rotatably connected to the piston 10. That is, the piston pin 15 is inserted into the piston pin installation hole 22 so as to connect the small end portion of the connecting rod 20 with the piston 10.

The eccentric cam installation hole 24 is formed in the large end portion of the connecting rod 20. In addition, the eccentric cam installation hole 24 has a circular shape such that the large end portion of the connecting rod 20 is rotatably connected with the crankshaft 40.

As described above, an overall configuration of the connecting rod 20 is similar to the existing connecting rod 20. Thus, the VCR apparatus may be installed while minimizing a change in the structure of an existing engine.

An eccentric cam 30 is disposed at one end of the eccentric link 34. The eccentric link 34 and the eccentric cam 30 are coupled by a coupling unit such as a pin or integrally or monolithically formed so as to rotate together. As the eccentric cam 30 is rotatably inserted into the eccentric cam installation hole 24 of the connecting rod 20, the eccentric link 34 is rotatably connected to the large end portion of the connecting rod 20. Further, the eccentric cam 30 may be concentrically inserted into the eccentric cam installation hole 24 and may be formed in a circular shape having an exterior diameter which is almost equal to an interior diameter of the eccentric cam installation hole 24.

The eccentric cam 30 includes a crank pin installation hole 32.

The crank pin installation hole 32 is eccentrically formed at the eccentric cam 30. In addition, a crank pin 45 is inserted into the crank pin installation hole 32 so as to rotatably connect the connecting rod 20 and the eccentric link 34 with the crankshaft 40. That is, the eccentric link 34 and the eccentric cam 30 rotate around the crank pin 45, and a center of the crank pin 45 is disposed apart from a center of the eccentric cam 30.

If the eccentric cam 30 rotates, a relative position of the crank pin 45 is to be changed with respect to the center of the eccentric cam 30. That is, relative positions of the connecting rod 20 and the piston 10 are to be changed with respect to the crankshaft 40. Thus, a compression ratio of a mixture is varied.

The variable link 50 functions to rotate the eccentric link 34 around the crank pin 45. In addition, one end of the variable link 50 is rotatably connected with the other end of the eccentric link 34.

The control link 65 functions to rotate the eccentric link 34 around the crank pin 45 by using the variable link 50. In addition, one end of the control link 65 is rotatably connected with the other end of the variable link 50.

The control shaft 60 is rotated according to operational conditions of the engine, and rotates the control link 65. In addition, the control link 65 is coupled to the control shaft 60 by a coupling unit such as a pin or is integrally or monolithically formed with the control shaft 60 so as to be rotated together with the control shaft 60. That is, the control link 65 is rotated by rotation of the control shaft 60. In addition, the control shaft 60 is disposed at the other end of the control link 65, and the control link 65 rotates around the control shaft 60.

Meanwhile, the control shaft 60 may be connected with an actuator. In addition, the operation of the actuator is controlled by a controller 70. That is, the controller 70 determines a compression ratio of a mixture according to operational condition of the engine, and operates the actuator. Therefore, the control shaft 60 rotates by the actuator being controlled depending on a control of the controller 70 such that a compression ratio of a mixture is varied. Herein, the actuator may be a motor which generates a torque by receiving electric power, the controller 70 may be a conventional electronic control unit (ECU) which comprehensively controls the electronic components of a vehicle.

In the specification, rotatable connections between link members 34, 50, and 65 refer to that the link members 34, 50, and 65 are connected through connection units such as pins 55 and 65, or the like, and are relatively rotatable. Herein, the control link 65 may be a connection pin 65 which eccentrically protrudes from the control shaft 60.

Figure 2:
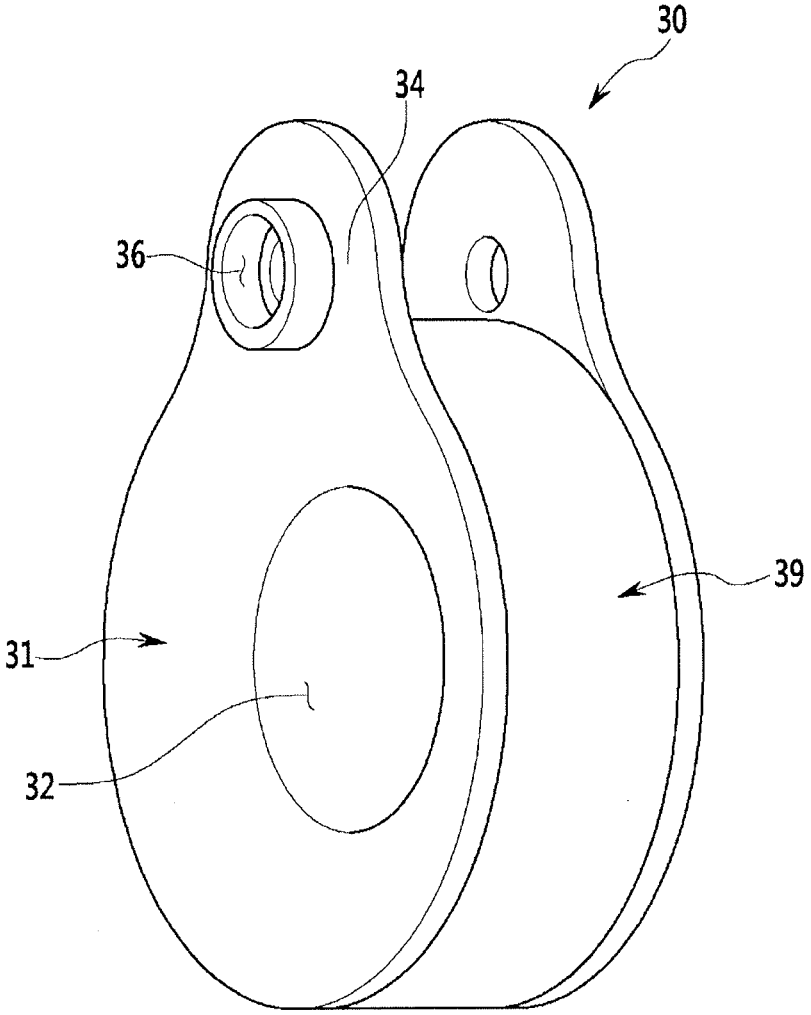
FIG. 2 is a perspective view an eccentric cam of the variable compression ratio apparatus according to various embodiments of the present invention.
Figure 3:
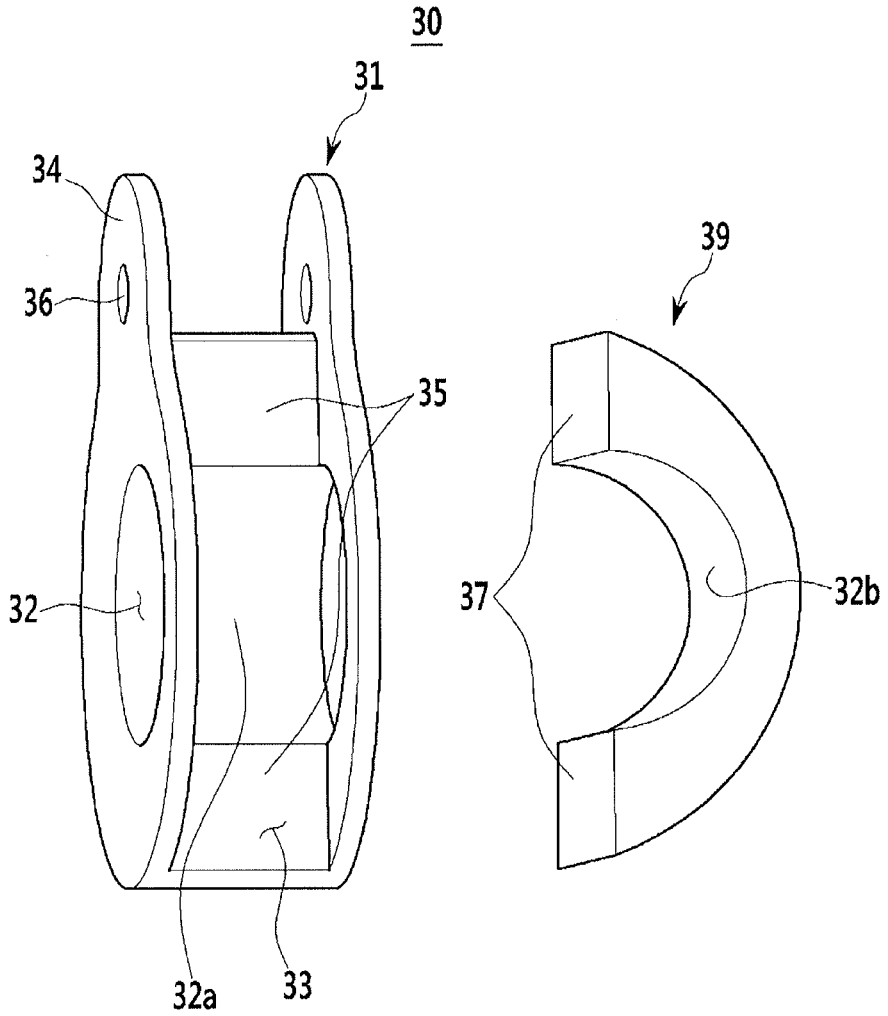
FIG. 3 is an exploded perspective view of the eccentric cam according to various embodiments of the present invention.

FIG. 2 is a perspective view an eccentric cam according to various embodiments of the present invention, and FIG. 3 is an exploded perspective view of the eccentric cam according to various embodiments of the present invention.

As shown in FIG. 2 and FIG. 3, the eccentric cam 30 includes a main body 31 and a sub body 39.

The eccentric link 34 is formed or disposed at the main body 31 of the eccentric cam 30. In FIG. 2 and FIG. 3, it is shown that the eccentric link 34 is integrally or monolithically formed at the eccentric cam 30, but it is not limited thereto. In addition, a pin insertion hole 36 is formed at the eccentric link 34 such that a connection pin 55 connecting the eccentric link 34 with the variable link 50 is inserted thereinto. Further, a first installation hole formed portion 32*a*, which forms a part of the crank pin installation hole 32, and a sub body insertion space 33, at which the sub body 39 is disposed, are formed at the main body 31 of the eccentric cam 30.

The sub body insertion space 33 is formed in a shape depressed along a radial direction from an external circumference of the eccentric cam 30. Meanwhile, as the sub body insertion space 33 is formed, a sub body contacting surface 35 is respectively formed at both sides in a diameter direction with respect to the first installation hole formed portion 32*a* at the main body 31.

A whole shape of the sub body 39 of the eccentric cam 30 is formed in a semicircle shape, and the sub body insertion space 33 is formed in a shape to correspond with the sub body 39. In addition, a second installation hole formed portion 32*b*, which forms the other part of the crank pin installation hole 32, is formed at the sub body 39 of the eccentric cam 30, and a main body contacting surface 37 is formed at both sides in a diameter direction with respect to the second installation hole formed portion 32*b*.

The first installation hole formed portion 32*a* and the second installation hole formed portion 32*b* are respectively formed in a semicircle shape as a groove, and the sub body 39 of the eccentric cam 30 is inserted into the sub body insertion space 33 of the main body 31 such that the crank pin installation hole 32 is formed. Herein, the sub body contacting surface 35 contacts with the main body contacting surface 37.

Thus, the eccentric cam 30 is constructed with the main body 31 and the sub body 39, so the eccentric cam 30 and the crank pin 45 may be easily connected.

FIG. 4 is a view illustrating operations of a variable compression ratio apparatus in a low compression ratio and a high compression ratio according to various embodiments of the present invention.

Figure 4A:
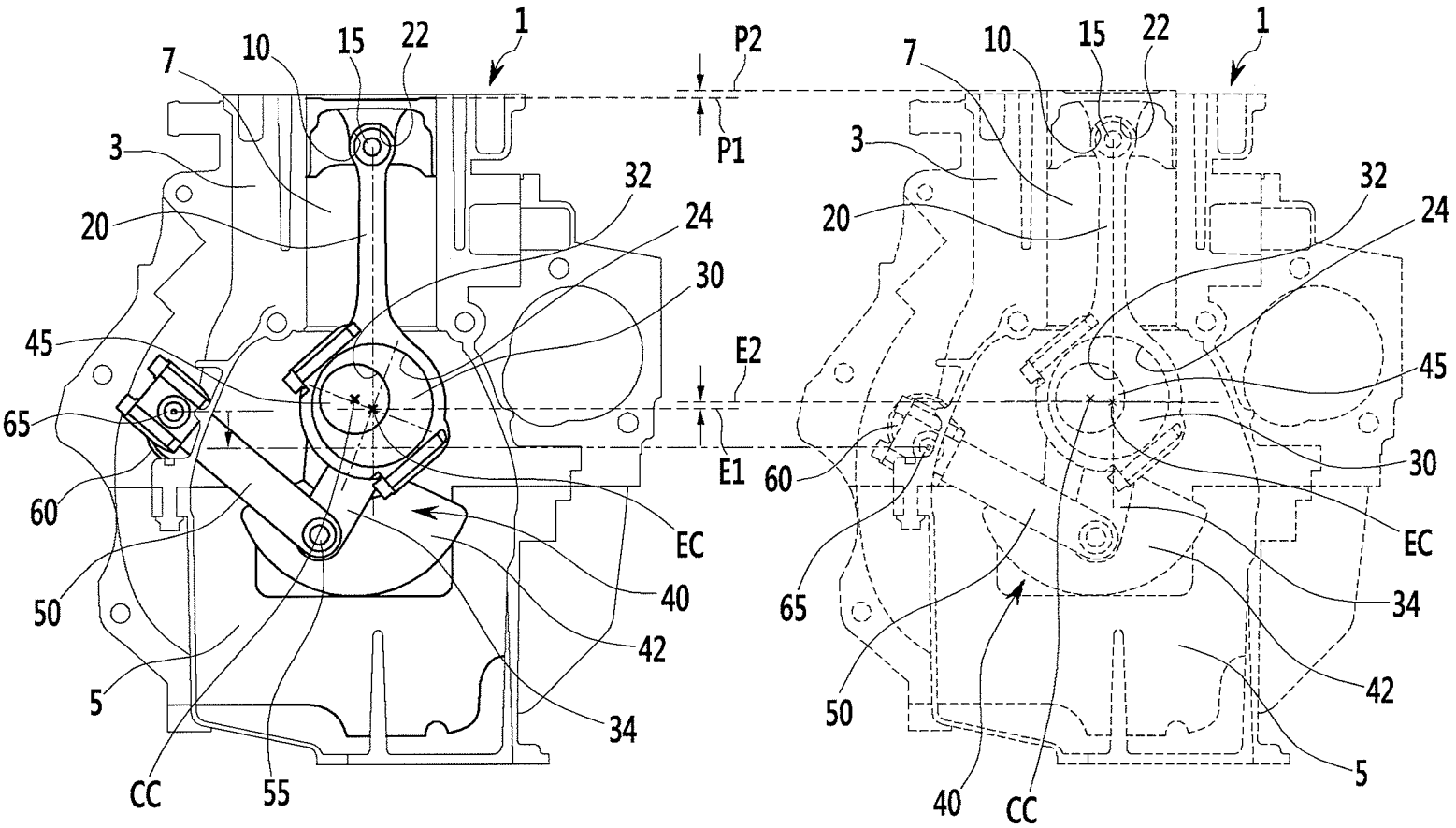
FIG. 4A and FIG. 4B are views illustrating operations of the variable compression ratio apparatus in a low compression ratio and a high compression ratio according to various embodiments of the present invention.

As shown in FIG. 4A, when the control shaft 60 is rotated in one direction on a condition that the engine should be operated at a low compression ratio, the control link 65 is rotated together with the control shaft 60 so as to pull the variable link 50. Thus, the eccentric link 34 and the eccentric cam 30 are rotated in a clockwise direction such that a relative position of the crank pin 45 center CC is to be high with respect to the eccentric cam 30 center EC in the eccentric cam installation hole 24 of the large end portion of the connecting rod 20. At this time, as the absolute positions of the crankshaft 40 and the crank pin 45 are not changed, a relative positions of the connecting rod 20 and the piston 10 is to be low with respect to the crankshaft 30. Therefore, a distance between the piston pin 15 and the crank pin 45 is to be short such that the low compression ratio of the engine is realized.

Figure 4B:
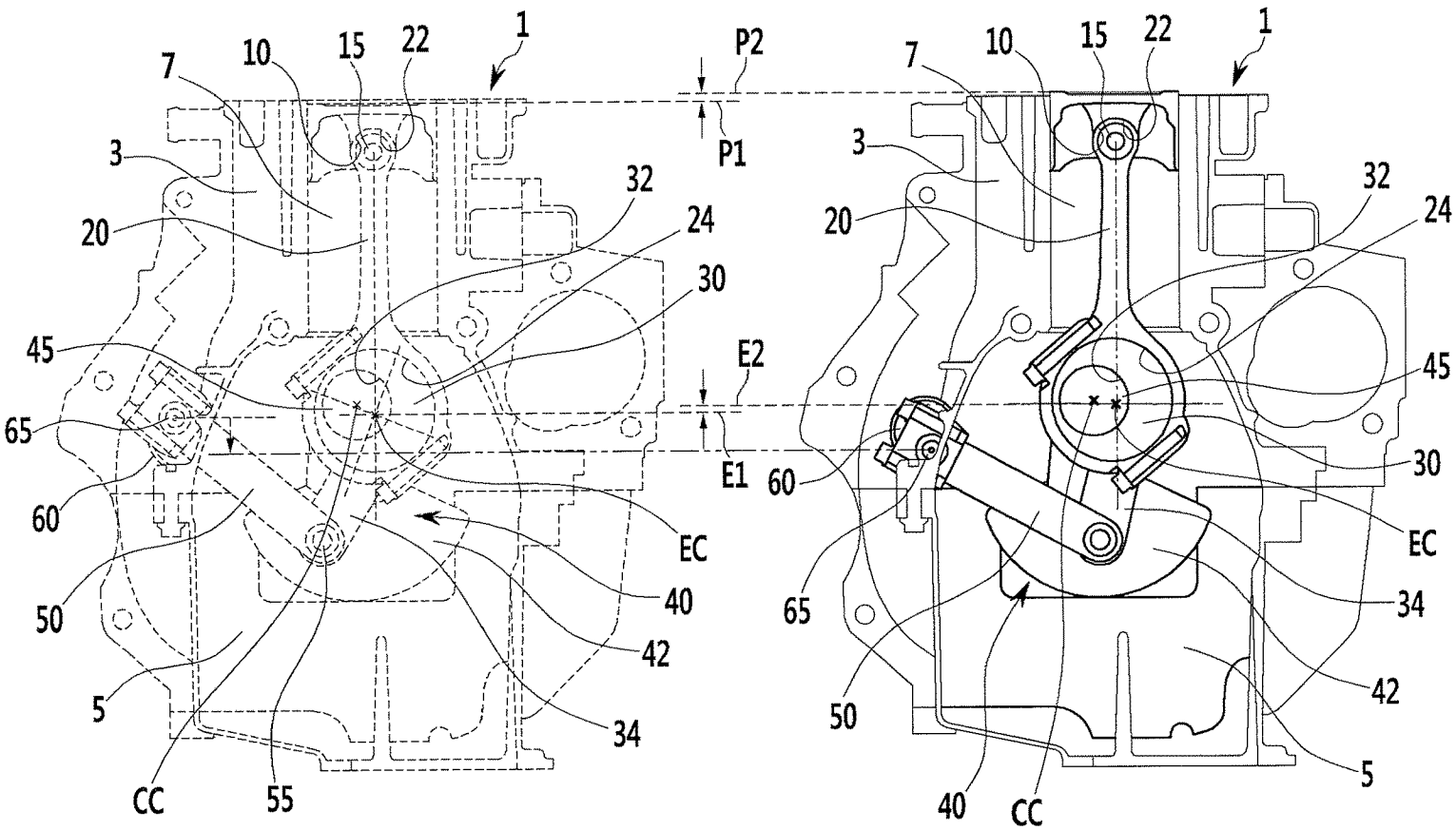

As shown in FIG. 4B, when the control shaft 60 is rotated in the other direction on a condition that the engine should be operated at a high compression ratio, the control link 65 is rotated in an anticlockwise direction together with the control shaft 60 so as to push the variable link 50. Thus, the eccentric link 34 and the eccentric cam 30 are rotated in the anticlockwise direction such that a relative position of the crank pin 45 center CC is to be low with respect to the eccentric cam 30 center EC in the eccentric cam installation hole 24 of the large end portion of the connecting rod 20. At this time, as the absolute positions of the crankshaft 40 and the crank pin 45 are not changed, a relative positions of the connecting rod 20 and the piston 10 is to be high with respect to the crankshaft 30. Therefore, the distance between the piston pin 15 and the crank pin 45 is formed to be long such that the high compression ratio of the engine is realized.

In FIGS. 4A and 4B, for visibly comparing the states in the low compression ratio and the high compression ratio of the engine, a height P1 of the piston 10 and a height E1 of the eccentric cam 30 center EC are illustrated as adjoining lines on the state of the low compression ratio in FIG. 4A and a height P2 of the piston 10 and a height E2 of the eccentric cam 30 center EC are illustrated as adjoining lines on the state of the high compression ratio in FIG. 4B.

As described above, according to various embodiments of the present invention, an operation time for installing the VCR apparatus and production cost can be reduced and a fuel consumption can be enhanced as the compression ratio of the mixture is varied depending on an operational state of the engine by using the link members 34, 50, and 65 even having a simple composition. Further, the VCR apparatus can be installed even while minimizing a change in the structure of the existing engine by using the connecting rod 20 applicable to an existing engine.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio apparatus provided to an engine rotating a crankshaft upon receiving combustion power of a mixture of fuel and air from a piston for changing a compression ratio of the mixture, the variable compression ratio apparatus comprising:

a connecting rod transferring the combustion power of the mixture received from the piston to the crankshaft, and including a small end rotatably connected with the piston and a large end including a first hole for rotatable and eccentric connection with the crankshaft;

a crank pin disposed at the crankshaft;

an eccentric cam disposed to be concentrically rotatable in the first hole of the large end for eccentric insertion and rotatable connection of the crank pin in the first hole;

an eccentric link including a first end at which the eccentric cam is disposed to rotate together with the eccentric cam;

a variable link having a first end rotatably connected with a second end of the eccentric link;

a control link having a first end rotatably connected with a second end of the variable link; and a control shaft disposed at a second end of the control link and controlled by a controller to be rotated together with the control link, wherein the eccentric cam comprises:

a main body at which the eccentric link is formed or disposed, and at which a first part of a second hole into which the crank pin is inserted is formed; and a sub body at which a second part of the second hole into which the crank pin is inserted is formed, and wherein a sub body insertion space is formed in the main body and the sub body is disposed in the sub body insertion space, and wherein the sub body is formed in a semicircle shape and the sub body insertion space is formed in a shape corresponding to the sub body.

2. The variable compression ratio apparatus of claim 1, wherein the rotation of the control link rotating together with the control shaft rotates the eccentric link through the variable link.

3. The variable compression ratio apparatus of claim 1, wherein the control shaft is controlled by the controller to rotate according to driving conditions of the engine.

4. The variable compression ratio apparatus of claim 1, wherein the sub body insertion space is formed in a shape depressed along a radial direction from an external circumference of the eccentric cam.

5. The variable compression ratio apparatus of claim 1, wherein the second hole into which the crank pin is inserted is formed by insertion of the sub body of the eccentric cam into the sub body insertion space of the main body.

* * * * *